United States Patent [19]

Griffith

[11] 4,236,589

[45] Dec. 2, 1980

[54] VACUUM MOTOR

[76] Inventor: Vern Griffith, P.O. Box 402433, Miami Beach, Fla. 33140

[21] Appl. No.: 973,083

[22] Filed: Dec. 26, 1978

[51] Int. Cl.[3] ..... B23B 45/04

[52] U.S. Cl. ..... 173/169

[58] Field of Search ..... 173/169, 163; 251/321, 251/325; 415/503

[56] References Cited

U.S. PATENT DOCUMENTS

| | | | |
|---|---|---|---|
| 2,233,163 | 2/1941 | Fosnot | 173/169 |
| 2,382,591 | 8/1945 | Warren | 173/163 |
| 2,493,957 | 1/1950 | Fitch | 251/321 |
| 2,768,546 | 10/1956 | Amtsberg | 415/503 UX |
| 3,169,585 | 2/1965 | Maurer | 173/169 |
| 3,195,702 | 7/1965 | Alexander | 173/169 X |
| 3,298,284 | 1/1967 | Alexander | 173/169 |
| 3,352,368 | 11/1967 | Maffey | 173/169 |
| 3,833,068 | 9/1974 | Hall | 173/163 |
| 3,951,217 | 4/1976 | Wallace et al. | 173/163 X |

*Primary Examiner*—Ronald Feldbaum

[57] ABSTRACT

A vacuum motor comprising a housing with a eccentrically mounted rotor composed of a rotor-body having a plurality of radially extending equi-spaced slits extending axially and a plurality of slidable vane members, one of which is in each of said rotor slits; there are a plurality of passageways in a sleeve coaxially lining the stator and a pair of spaced holes are provided in a control member slidable captivated on the stator to selectively control suction forces applied to the vanes from a source so as to provide a differential pressure on one of the vanes on one face while the other face of the vane is exposed to atmospheric pressure, whereby, upon selective operation of a trigger mechanism to control suction application, the rotor will turn to deliver power to drive a gear train or other suitable mechanical mechanism for producing useful work, as is set forth more fully hereinafter.

7 Claims, 4 Drawing Figures

VACUUM MOTOR

FIELD OF THE INVENTION

This invention relates to a vacuum motor and a utilization of the said vacuum motor.

BACKGROUND OF THE INVENTION

In the past there have been numerous occasions where vacuum motors have been useful. This invention is of a vacuum powered motor and, more specifically, it is of a vacuum powered motor of the type which is set forth more fully and described hereinafter. The vacuum motor of the instant invention may be powered by the available vacuum from the intake manifold of a conventional internal combustion engine or, for example, from a vacuum cleaner. It will be appreciated that in the production of energy from an internal combustion engine there is available vacuum from the intake manifold, which varies depending upon the idle speed. The vacuum flow rate from internal combustion engines, irrespective of what its amount may be in cubic feet per minute is significant. The concept of this invention is to utilize vacuum flow energy to obtain useful work and more specifically, to utilize the same as a motor, which is hand held. For example, a motor driven by such vacuum forces may be used in an emergency, to power the jack of a car as well as for various other types of operations, such a paint spraying device, a compressor, a winch, whether it is for a trailer to haul a boat or for an anchor on a boat and, of interest to the ladies, as a wrench to remove lug bolts when a spare tire is to be changed.

OBJECTS OF THE INVENTION

It is, according, an object of this invention to provide a vacuum driven motor of the type described more fully hereinafter which is simple and inexpensive and which is characterized by the features which are described in the following description as well as the drawings and which will find use in a wide variety of application.

In accordance with these and other object which will become more apparent hereinafter, this invention will now be described with reference to the accompanying drawings in which:

DESCRIPTION OF THE PREFERRED EMBODIMENT

Figure 1:
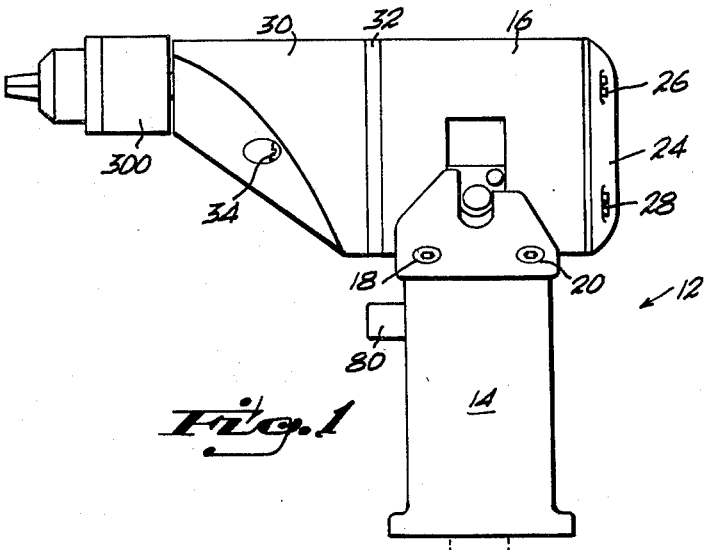
FIG. 1 is a side elevation view of a tool equipped with the vacuum motor.

Referring to the drawings and particularly to FIG. 1, the tool is designated by the numeral 12. It includes a vacuum driven motor which is adapted to be connected through a nipple and supply tube to a vacuum source as is indicated by the chain dot lines at the bottom of FIG. 1. The tool includes a handle 14 with a through passageway 72 from the nipple 76 to the interior of a housing 16 which is connected to it by means of bolts 18 and 20.

The housing 16 includes a longitudinally or, as shown in FIG. 1, horizontally extending bore and is generally cylindrical being closed at one end by a cap 24 and at the other end by a ring 32. To the forward side of the ring there is mounted a casing 30 which is secured to the housing by means of bolts such as that designated by the numeral 34 in FIG. 1. Within this casing there is a gear train 200 with a gear connected by key means on to the shaft so as to be in driving relation of a conventional tool chuck assembly 300. This is adapted to turn when the motor operates. The cap 24, as well as the ring 32, is provided, with an axial through bore 102 in communication with the interior cylindrical chamber 100 of the tool housing 16. This chamber is lined by a co-cylindrical sleeve 40. Within this chamber, there is eccentrically journaled a rotor 100, see FIGS. 3 and 4. The rotor has a plurality of circumferentially equally spaced, radially extending slits such as 402 and 404, each of which is sized to receive a vane, such as 406, for radially sliding movement thereof. The fit is such that the vane will move downwardly under the influence of gravity to touch the ring 40.

Figure 3:
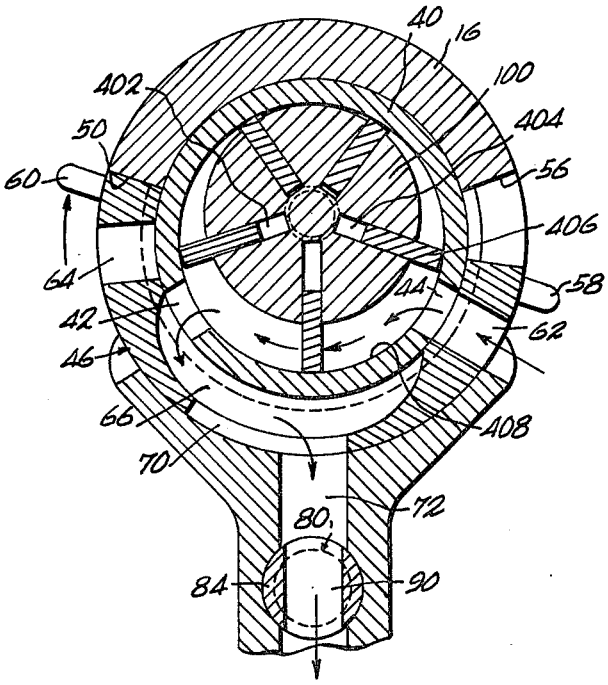
FIG. 3 is view in cross-section taken on the plane indicated by the 3—3 and looking in the direction of the arrows.
Figure 4:
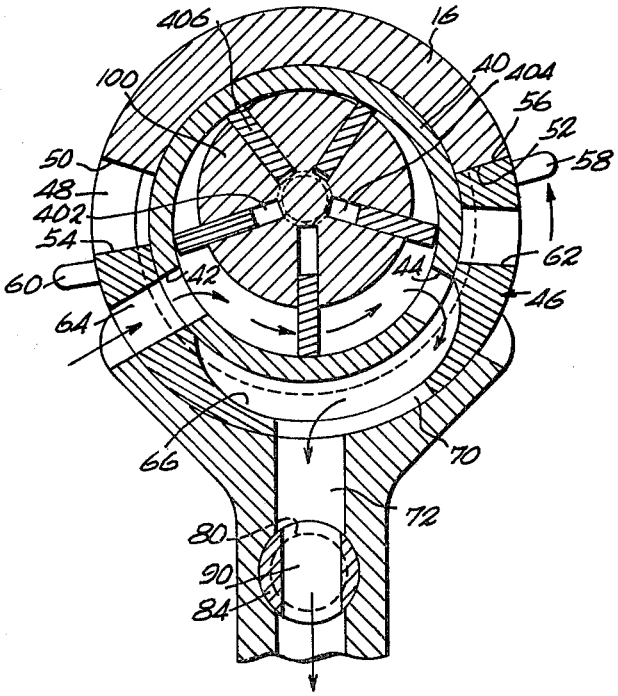
FIG. 4 is a view similar to FIG. 3 and illustrating the vanes of the tool motor in a different attitude in operation.

It is seen, on reference to FIGS. 3 and 4 that, as the rotor rotates, the vanes will be thrust outwardly by centrifugal forces so that their outer edges are in engagement with the interior of the housing ring, or a sleeve insert 40. The rotor includes a shaft which extends axially into the cap 24, as is designated by the numeral 110. The shaft is sized for rotation in the bore 102, which is counter bored to accommodate the bearing member 112. The other housing end, composed of the annular member 32 has a bore with a bearing member 124 to support the other end of the rotor shaft, which projects outwardly and may be conveniently provided with a gear keyed to it for for inclusion in the gear train 200.

Figure 2:
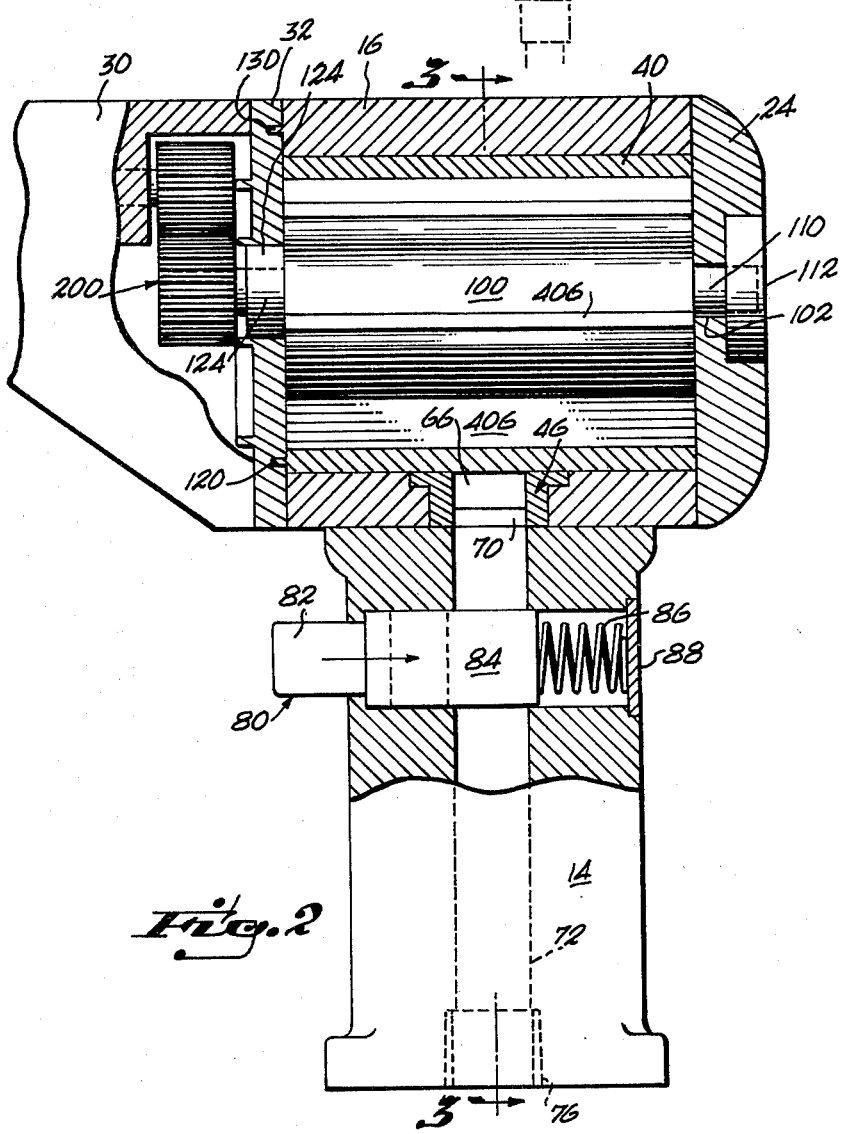
FIG. 2 is a view partly in cross-section of the tool of FIG. 1.

Referring now to the sleeve 40, that is, the liner member within the chamber of the housing, it is seen that it is provided with a first and second spaced radial passageway one of which is designated by the numerals 42 and the other which is designated by the numeral 44, these passageways are spaced from one another a predetermined circumferential distance. Additionally, the housing is provided with a arcuately extending slit 66 symmetrical with respect to a plane vertically through the handle and diametrically through the rotor. In the slit, there is captivated a slidably control member 46 adapted for circumferential movement. This member has a first radially extending passageway 62 and a second radially extending passageway 64 spaced from one another a predetermined circumferential distance. Further, extending vertically there is an opening 70 in open communication with the handle passageway 72 through which a vacuum is drawn. This is effective to suck air through the passageway 42 or 44 on one side or ther other or an intermediate vane as shown in FIG. 2 and FIG. 3 to cause a differential pressure or force to be applied to the vane on the other side of which the vacuum is applied. The handle passageway 70 is provided with a closure means which is trigger operated, which is now to be described with reference to FIG. 2. This mechanism 80 includes a trigger 82 which is adapted to telescopingly move in captivated relation axially with a member 84 to cause a diametrical opening 90 to open or close the suction path, urged by spring 80 which bears against the keeper plate to a normal closed position. The trigger is but effective upon application of finger tip pressure to move to the open position of alignment of holes 90 and 70. The keeper 88 is press fitted into a recess in the handle. Upon trigger operation, a passageway is opened as indicated by the arrowed lines in FIGS. 3 and 4.

In use, upon the application of a vacuum and the depression of the trigger member 82, the opening 90 will permit the vacuum to be drawn through the arcuate slit 66 and the passageway 42 of the ring 408, causing an unequal pressure to be exerted on the most exposed radial fin of the eccentric rotor. This will in turn impart a movement of rotation to the rotor. It will be noted that through the passageway 62 in FIG. 3, ambient pressure may enter and affect the fin in addition to the vacuum causing rotation by means of the differential in pressure. It will further be seen that the angularly movable control member in the arcuate housing slit is provided with radially extending operator members 58 and 60 so that the holes 62 and 64 may be oriented selectively, as shown in FIGS. 3 and 4. Stop means to limit movement are the ends 52 and 54 which bear against the housing either at 50 or 56 respectively. Upon the application of the suction forces, depending upon the position of the rotor vanes, whether as shown in FIG. 3 or FIG. 4, there will be a differential pressure which will cause rotation of the rotor and, once initiated, the same will build up and cause a vacuum driven motor operation to ensue which may be transmitted through the gear train to a suitable tool such as that designated by the numeral 300. The motore may be reveresed by simple movement of the angularly movable member in the housing slit by means of the exteriorly excessible operator 58 or 60.

While the instant invention has been shown and described in the drawings in a preferred embodiment, and, in certain detail in the above written description, it is recognized that the departures may be made from those specific disclosures within the spirit and scope of the overall invention as is defined more fully in the claims which follow and, accordingly, the applicant is entitled to the full range of the equivalence thereof.

What is claimed is:

1. A vacuum driven motor comprising a housing including a stator with a cylindrical rotor chamber, a cylindrical rotor eccentrically journaled for rotation within the stator chamber said rotor having an axially projecting portion extending outwardly of the stator, said rotor including a plurality of circumferentially spaced radially extending slits and a rotor vane radially slidably captivated in each slit between the stator and the rotor, said stator including a liner means of sleeve form between the rotor and the stator, said sleeve having a first and second circumferentially spaced, radially extending through opening for fluid flow into and out of the space between said rotor and said sleeve, said through opening being circumferentially spaced a first predetermined distance from one another, said housing having an acurate slot extending a distance greater than said first predetermined distance, a circumferentially movable arcuate control member slidably captivated in said slot, said member having a first and second circumferentially spaced radially extending passageway and with an intermediately arcuate through mouth of a circumferential span less then said first perdetermined distance, the control member passageways being spaced a distance greater than said first predetermined distance and said slidable member being arcuately movable slidably in the slot for circumferential movement of the member relative to the sleeve to register selectively one of the sleeve openings with the arcuate mouth and one of the passageways of the slidable member with one of the sleeve openings with the other of the passageways of the slidable member being closed to complete a passageway communicating with a suction source on one side of a vane between the sleeve openings and a passageway communicating with ambient pressure on the other side of the said vane between the sleeve openings, said vanes being equi-spaced from one another a distance less than said predetermined distance.

2. The device as set forth in claim 1 wherein a gear train is provided connected to said shaft of said rotor exteriorly of said housing for transmitting mechanical force of rotation.

3. The device as set forth in claim 1 wherein a trigger means is provided in the handle passageway to control suction forces.

4. The device as set forth in claim 1 wherein the passageway is included in a handle.

5. The device as set forth in claim 1 wherein said vacuum motor is provided in a hand-held tool.

6. The device as set forth in claim 1 wherein the motor is set forth in a tool generally as described in the drawings of the instant invention.

7. The device as set forth in claim 1 wherein the motor is included in a hand-held device as set forth specifically in the drawings included in this application.

* * * * *